US011764476B2

(12) United States Patent
Chan et al.

(10) Patent No.: US 11,764,476 B2
(45) Date of Patent: Sep. 19, 2023

(54) ANTENNA DEVICE

(71) Applicants: Chun-Cheng Chan, Taipei (TW); Shih-Chia Liu, Taipei (TW); Yen-Hao Yu, Taipei (TW); Li-Chun Lee, Taipei (TW); Jui-Hung Lai, Taipei (TW)

(72) Inventors: Chun-Cheng Chan, Taipei (TW); Shih-Chia Liu, Taipei (TW); Yen-Hao Yu, Taipei (TW); Li-Chun Lee, Taipei (TW); Jui-Hung Lai, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 125 days.

(21) Appl. No.: 17/211,825

(22) Filed: Mar. 25, 2021

(65) Prior Publication Data

US 2021/0305706 A1 Sep. 30, 2021

Related U.S. Application Data

(60) Provisional application No. 63/001,558, filed on Mar. 30, 2020.

(51) Int. Cl.

| | |
|---|---|
| ***H01Q 1/22*** | (2006.01) |
| ***H01Q 9/42*** | (2006.01) |
| ***H01Q 1/48*** | (2006.01) |

(52) U.S. Cl.

CPC ..... *H01Q 9/42* (2013.01); *H01Q 1/48* (2013.01)

(58) Field of Classification Search

CPC ..... H01Q 1/22–24; H01Q 1/38–48; H01Q 1/2266; H01Q 9/42

See application file for complete search history.

(56) References Cited

U.S. PATENT DOCUMENTS

| | | | | |
|---|---|---|---|---|
| 7,079,079 | B2 * | 7/2006 | Jo | H01Q 9/0421 343/702 |
| 9,692,105 | B2 * | 6/2017 | Watanabe | H01Q 21/28 |
| 2012/0105303 | A1 * | 5/2012 | Kusanagi | H01Q 9/0421 343/905 |
| 2015/0295303 | A1 * | 10/2015 | Lee | H01Q 21/28 343/702 |
| 2018/0261923 | A1 * | 9/2018 | Shehan | H01Q 9/0485 |
| 2022/0302589 | A1 * | 9/2022 | Koshi | H01Q 5/385 |

FOREIGN PATENT DOCUMENTS

| | | |
|---|---|---|
| TW | 201332207 | 8/2013 |
| TW | I518984 | 1/2016 |
| TW | I612724 | 1/2018 |

OTHER PUBLICATIONS

"Office Action of Taiwan Counterpart Application", dated Dec. 7, 2021, p. 1-p. 6.

* cited by examiner

*Primary Examiner* — Hasan Islam
(74) *Attorney, Agent, or Firm* — JCIPRNET

(57) ABSTRACT

An antenna device is disposed. The antenna device includes a signal cable, a casing, a grounding component, and a metal member. The signal cable includes a signal portion and a grounding portion. The signal cable is fixed on the casing. The grounding portion is connected to the metal member through the grounding component.

22 Claims, 6 Drawing Sheets

ANTENNA DEVICE

CROSS-REFERENCE TO RELATED APPLICATION

This application claims the priority benefits of U.S. provisional application Ser. No. 63/001,558, filed on Mar. 30, 2020. The entirety of the patent application is hereby incorporated by reference herein and made a part of this specification.

BACKGROUND

Technical Field

The disclosure relates to an antenna device.

Description of Related Art

With the development of communication technology, communication protocols of communication products also become more diverse. Accordingly, the frequency of signal transmission needed by the communication products has also increased gradually. For the convenience of adjusting the antenna layout, most of the antenna devices of the communication products are made of printed circuit boards (PCBs). However, once the PCB antenna device is manufactured, the layout of the antenna device cannot be modified. Therefore, when the manufacturers are to produce a variety of communication products, they often need to make PCB antenna devices for each communication product, as it is not possible to adapt the antenna device to different communication products without adjusting the PCB antenna layout.

SUMMARY

The present disclosure provides an antenna device capable of adjusting only signal cables to adapt to different communication products.

The antenna device of the present disclosure includes a signal cable, a casing, a grounding component, and a metal member. The signal cable includes a signal portion and a grounding portion. The signal cable is fixed on the casing. The grounding portion is connected to the metal member through the grounding component.

In an embodiment of the present disclosure, the grounding component includes a first part connected to the metal member and a second part connected to the first part.

In an embodiment of the present disclosure, a first side of the first part is perpendicular to a second side of the second part.

In an embodiment of the present disclosure, the signal portion extends along a direction parallel to the second side.

In an embodiment of the present disclosure, the grounding component is disposed between the signal cable and the casing.

In an embodiment of the present disclosure, the signal cable is disposed between the grounding component and the casing.

In an embodiment of the present disclosure, the grounding component and the metal member are formed integrally.

In an embodiment of the present disclosure, the grounding component includes one of copper foil, aluminum foil, and conductive cloth.

In an embodiment of the present disclosure, the casing includes at least one fixing member, and the signal cable is fixed to the casing by the at least one fixing member.

In an embodiment of the present disclosure, the at least one fixing member includes a rib of the casing.

In an embodiment of the present disclosure, the metal member is a system grounding of the electronic device.

In an embodiment of the present disclosure, the casing is a chassis of an electronic device, and the signal cable is fixed on an inner face of the chassis.

In an embodiment of the present disclosure, the signal cable is a coaxial cable, where the grounding portion is a metal material, and the signal portion includes a core wire and an insulating layer.

In an embodiment of the present disclosure, the grounding portion is connected to the grounding component through one of solder and conductive glue.

In an embodiment of the present disclosure, the length of the signal portion is equal to a quarter wavelength of a first radio frequency signal.

In an embodiment of the present disclosure, the length of the signal portion is equal to a three-quarter wavelength of a second radio frequency signal.

In an embodiment of the present disclosure, the longest distance between the grounding portion and the second part is equal to a quarter wavelength of a third radio frequency signal.

In an embodiment of the present disclosure, the second part is a meandering structure.

In an embodiment of the present disclosure, the meandering structure extends along a direction perpendicular to the first side of the first part.

In an embodiment of the present disclosure, the grounding component further includes a third part connected to the first part, where a third side of the third part is perpendicular to the first side of the first part.

In an embodiment of the present disclosure, the grounding portion is connected electrically to at least one of the first part and the third part.

In an embodiment of the present disclosure, the grounding component further includes a third part extending along a first direction perpendicular to the second side, where the third part is connected to the second part.

In an embodiment of the present disclosure, the grounding component further includes a fourth part extending along a fourth direction parallel to the second side, wherein the fourth part is connected to the third part.

In an embodiment of the present disclosure, the grounding component further includes a third part extending along a third direction parallel to the first side, wherein the third part is connected to the first part.

Based on the above, the antenna device of the present disclosure may replace the conventional PCB antenna device. The hardware in the antenna device can be adjusted based on the needs of users to adapt to different frequency bands.

DESCRIPTION OF THE EMBODIMENTS

Figure 1:
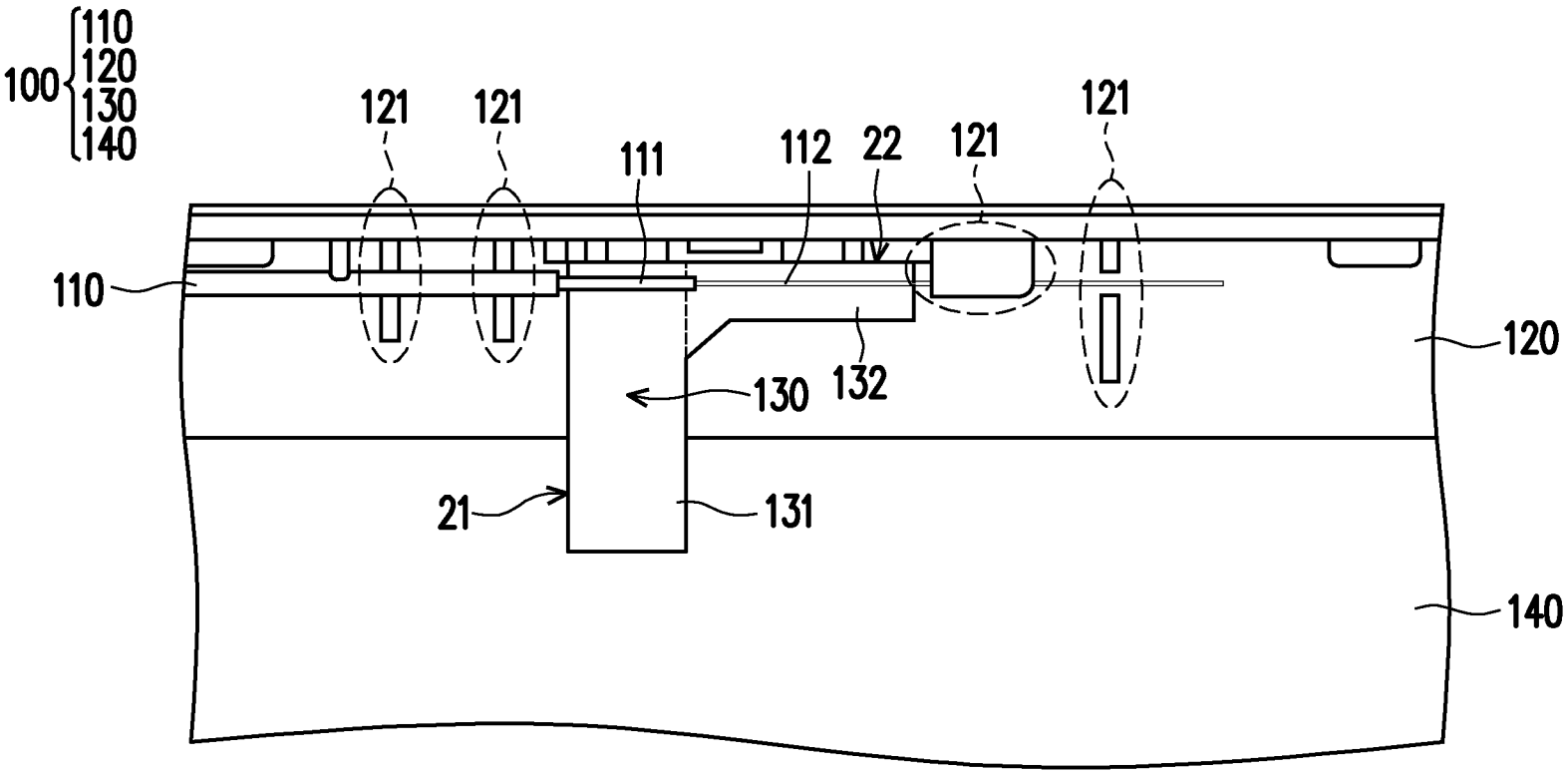
FIG. 1 shows a schematic diagram of an antenna device according to an embodiment of the present disclosure.

FIG. 1 shows a schematic diagram of an antenna device 100 according to an embodiment of the present disclosure. The antenna device 100 may include a signal cable 110, a casing 120, a grounding component 130, and a metal member 140. The antenna device 100 may be installed in an electronic device with a wireless communication function, so that the electronic device can transmit or receive wireless signals through the antenna device 100.

The signal cable 110 may include a grounding portion 111 and a signal portion 112. The signal cable 110 is, for example, a coaxial cable. Coaxial cables may include cores, insulating layers, shields, and insulating plastics from the inside out. In this embodiment, the signal portion 112 of the signal cable 110 may include a core wire and an insulating layer, and the grounding portion 111 of the signal cable 110 may include a core wire, an insulating layer, and a shielding layer covering the core wire and the insulating layer. The shielding layer is, for example, braided by metal wires or made of a metal material. The signal cable 110 transmits or receives wireless signals through the signal portion 112.

The grounding component 130 is, for example, copper foil, aluminum foil, or other types of metal sheets or conductive cloth. The grounding portion 111 may be connected electrically to the metal member 140 through the grounding component 130. The grounding portion 111 and the metal member 140 may be respectively overlapped with the grounding component 130, so that the grounding portion 111 and the metal member 140 are connected electrically. The metal member 140 is, for example, a system grounding of an electronic device installed with the antenna device 100. For example, if the antenna device 100 is installed in a notebook computer, the metal member 140 may be the system grounding of the notebook computer. In an embodiment, the grounding component 130 and the metal member 140 may be formed integrally.

The casing 140 may include one or more fixing members. The signal cable 110 may be fixed to the casing 140 by the fixing member. For example, the casing 140 may include one or more ribs 121. The signal cable 110 may be fixed to the casing 140 by the rib 121. The casing 140 is, for example, a chassis of an electronic device installed with the antenna device 100. For example, if the antenna device 100 is installed in a notebook computer, the casing 140 may be the chassis of the notebook computer. The signal cable 110 may be fixed on the inner face of the chassis.

In an embodiment, the grounding component 130 may be disposed between the signal cable 110 and the casing 140, as shown in FIG. 1. In another embodiment, the signal cable 110 may be disposed between the grounding component 130 and the casing 140.

Figure 2:
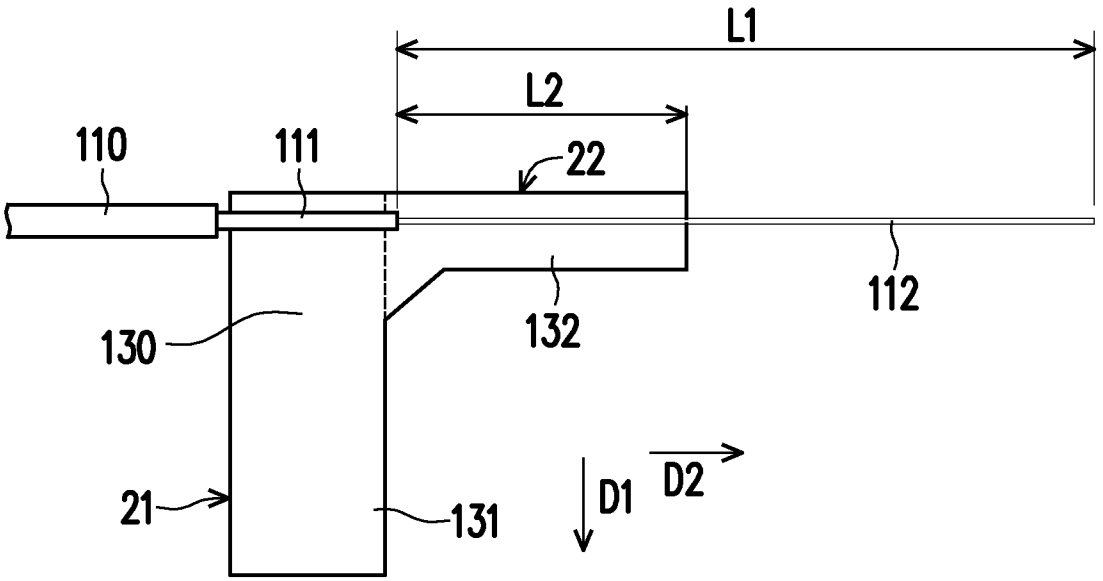
FIG. 2 shows a schematic diagram of a grounding component and a signal cable according to an embodiment of the present disclosure.

The shape and/or length of the grounding component 130 or the signal portion 112 of the signal cable 110 can be adjusted based on the needs of the user. FIG. 2 is a schematic diagram of a grounding component 130 and a signal cable 110 according to an embodiment of the present disclosure. The grounding component 130 may include a first part 131 and a second part 132. One end of the first part 131 may be connected to a metal member 140, whereas the other end of the first part 131 may be connected to the second part 132. A side 21 of the first part 131 may be perpendicular to a side 22 of the second part 132. If the first part 131 extends along a direction D1, the second part 132 may extend along a direction D2 that is perpendicular to the direction D1. For example, if the first part 131 is rectangular and the second part 132 is also rectangular, the long side of the first part 131 (i.e., the side 21) may be perpendicular to the long side of the second part 132 (i.e., the side 22). The shape of the grounding component 130 may be similar to the "L" shape, as shown in FIG. 2. And a signal portion 112 of the signal cable 110 may extend along a direction parallel to the long side (i.e., the side 22) of the second part 132.

Figure 3:
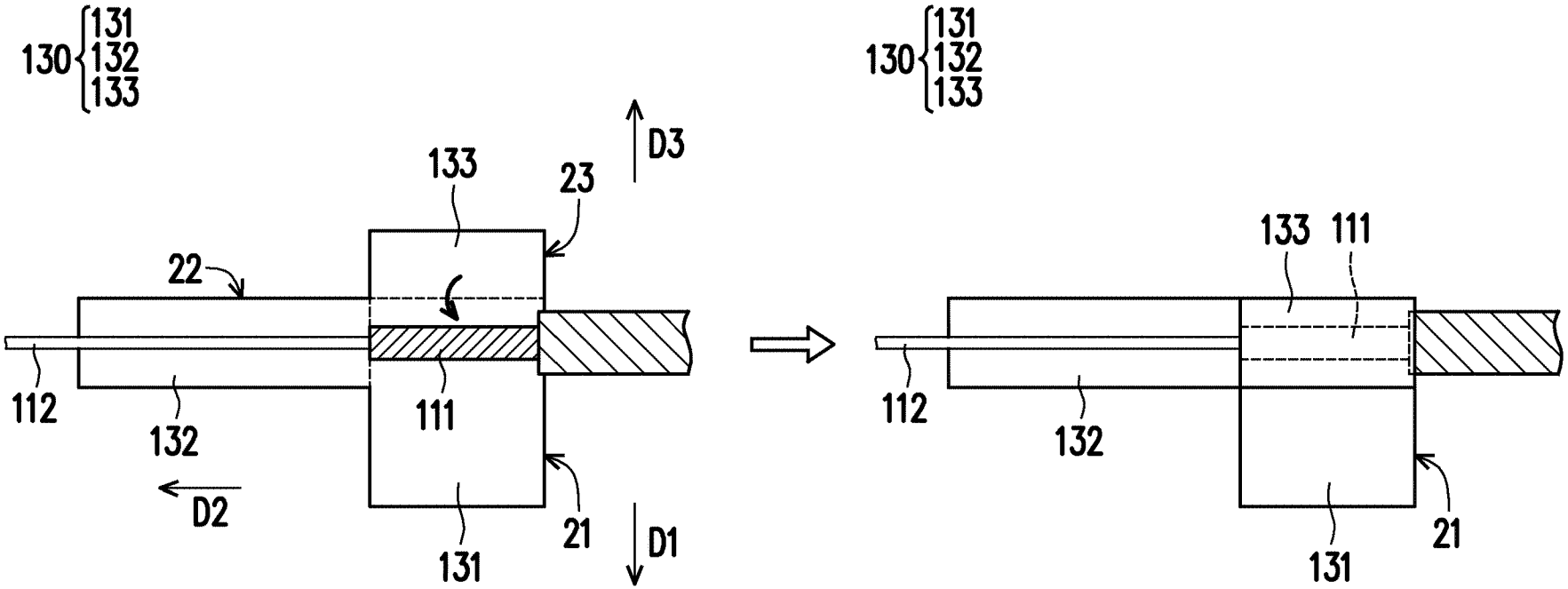
FIG. 3 illustrates a schematic diagram of connecting a grounding portion of a signal cable to a grounding component according to an embodiment of the present disclosure.

The grounding portion 111 of the signal cable 110 may be connected to the grounding component 130 by solder or conductive glue. In an embodiment, the grounding component 130 may cover the grounding portion 111. FIG. 3 is a schematic diagram of connecting a grounding portion 111 of a signal cable 110 to a grounding component 130 according to an embodiment of the present disclosure. In the embodiment of FIG. 3, the grounding component 130 may further include a third part 133. The third part 133 may be connected to a first part 131. A side 23 of the third part 133 may be perpendicular to a side 22 of a second part 132. If the first part 131 extends along a direction D1, the third part 133 may extend in a direction D3 that is parallel and opposite to the direction D1. After the grounding portion 111 is disposed on the first part 131, the third part 133 (and part of the first part 131) may be folded to cover the grounding portion 111. The first part 131 and the third part 133 may be connected to the grounding portion 111 by solder or conductive glue.

Returning to FIG. 2, the antenna device 100 may be configured to support a first resonance mode, a second resonance mode, and a third resonance mode. The first resonance mode, the second resonance mode, and the third resonance mode may respectively correspond to a first radio frequency signal, a second radio frequency signal, and a third radio frequency signal which have different frequencies.

In one embodiment, the length of the signal portion 112 of the signal cable 110 may be configured for the antenna device 100 to support the first radio frequency signal. Taking FIG. 2 as an example, a length L1 of the signal portion 112 may be configured to be equal to a quarter wavelength of the first radio frequency signal.

In one embodiment, the coupling amount between the signal portion 112 of the signal cable 110 and the second part 132 of the grounding component 130 can be adjusted for the antenna device 100 to support the second radio frequency signal. The frequency of the second radio frequency signal may be a multiple of the frequency of the first radio frequency signal. The length L1 of the signal portion 112 may be configured to be equal to a three-quarter wavelength of the second radio frequency signal.

In one embodiment, the grounding component 130 is adjusted so that the antenna device 100 supports the third radio frequency signal. Taking FIG. 2 as an example, a longest distance L2 between the grounding portion 111 and the second part 132 (that is, the distance between the grounding portion 111 and the end of the second part 132) may be configured to be equal to a quarter wavelength of the third radio frequency signal.

The shape of the grounding component 130 may be configured for the antenna device 100 to support radio frequency signals having a specific frequency. FIGS. 4A, 4B, 4C, 4D, and 4E are schematic diagrams of various configurations of a grounding component 130 according to embodiments of the present disclosure.

Figure 4A:
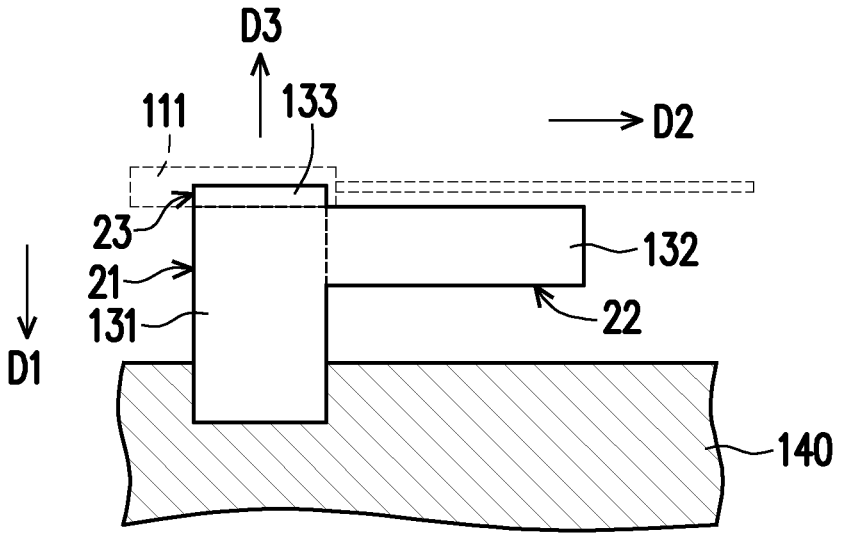
FIGS. 4A, 4B, 4C, 4D, and 4E are schematic diagrams of various configurations of a grounding component according to embodiments of the present disclosure.

In the embodiment of FIG. 4A, the grounding component 130 includes a first part 131, a second part 132, and a third part 133. One end of the first part 131 may be connected to a metal member 140, and the other end of the first part 131 may be connected to the second part 132 and the third part 133. A side 21 of the first part 131 may be perpendicular to a side 22 of the second part 132, and a side 23 of the third part 133 may be perpendicular to the side 22 of the second part 132. If the first part 131 (or the side 21) extends along a direction D1, the second part 132 (or the side 22) extends along a direction D2 that is perpendicular to the direction D1, and the third part 133 (or the side 23) may extend along a direction D3 that is parallel and opposite to the direction D1. A grounding portion 111 of the signal cable 110 may be connected to the third part 133 by solder or conductive glue, thereby being connected electrically to the metal member 140.

Figure 4B:
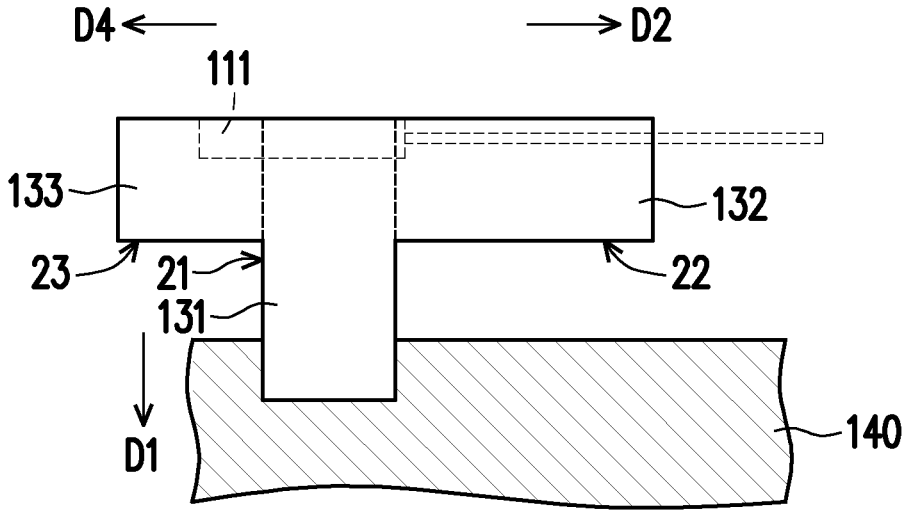

In the embodiment of FIG. 4B, the grounding component 130 includes a first part 131, a second part 132, and a third part 133. One end of the first part 131 may be connected to a metal member 140, and the other end of the first part 131 may be connected to the second part 132 and the third part 133. A side 21 of the first part 131 may be perpendicular to a side 22 of the second part 132, and the side 21 of the first part 131 may be perpendicular to a side 23 of the third part 133. If the first part 131 (or the side 21) extends along a direction D1, the second part 132 (or the side 22) may extend along a direction D2 perpendicular to the direction D1, and the third part 133 (or the side 23) may extend along a direction D4 parallel and opposite to the direction D2. A grounding portion 111 of the signal cable 110 may be connected to the first part 131 and/or the third part 133 by solder or conductive glue.

Figure 4C:
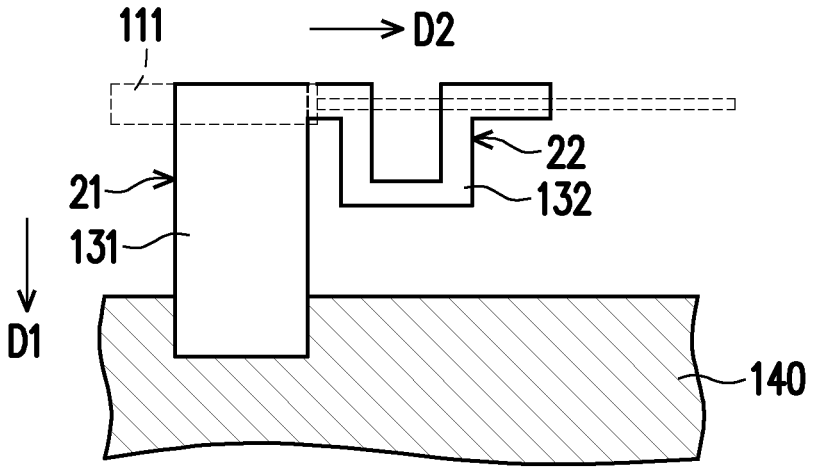

In the embodiment of FIG. 4C, the grounding component 130 includes a first part 131 and a second part 132. One end of the first part 131 may be connected with a metal member 140, and the other end of the first part 131 may be connected with the second part 132. The second part 132 may have a meandering structure. The meandering structure may extend along a direction perpendicular to a side 21 of the first part 131. For example, if the first part 131 is rectangular and the long sides of the rectangle extend along the direction D1, the meandering structure may extend along a direction D2 perpendicular to the direction D1.

Figure 4D:
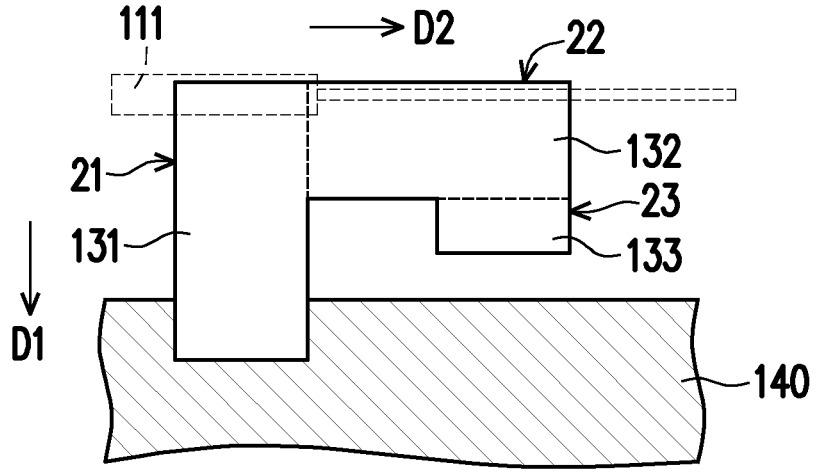

In the embodiment of FIG. 4D, the grounding component 130 includes a first part 131, a second part 132, and a third part 133. One end of the first part 131 may be connected with a metal member 140, and the other end of the first part 131 may be connected with the second part 132. One end of the second part 132 may be connected to the first part 131, and the other end of the second part 132 may be connected to the third part 133. A side 21 of the first part 131 may be perpendicular to a side 22 of the second part 132, and a side 23 of the third part 133 may be perpendicular to the side 22 of the second part 132. If the first part 131 (or the side 21) extends along a direction D1, the second part 132 (or the side 22) may extend along a direction D2 perpendicular to the direction D1, and the third part 133 (or the side 23) may extend along the direction D1 to point to the metal member 140.

Figure 4E:
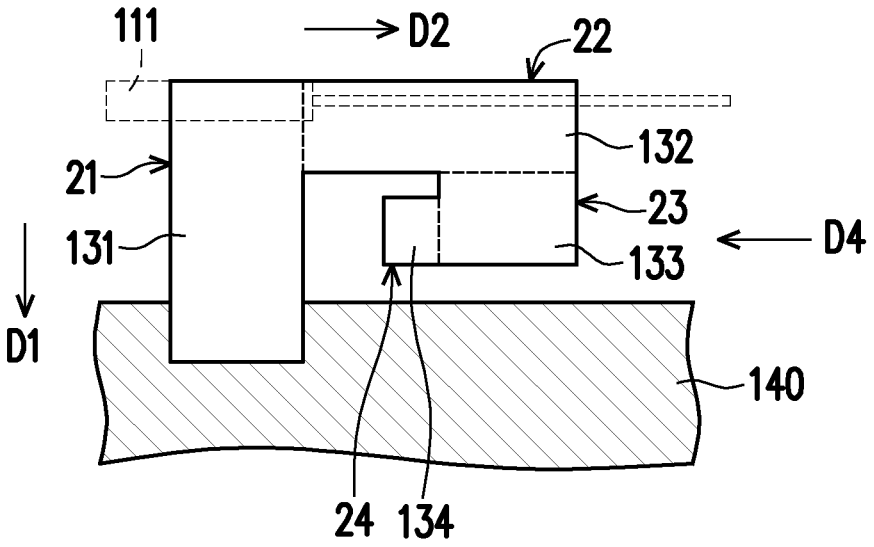

In the embodiment of FIG. 4E, the grounding component 130 includes a first part 131, a second part 132, a third part 133, and a fourth part 134. One end of the first part 131 may be connected with a metal member 140, and the other end of the first part 131 may be connected with the second part 132. One end of the second part 132 may be connected to the first part 131, and the other end of the second part 132 may be connected to the third part 133. One end of the third part 133 may be connected to the second part 132, and the other end of the third part 133 may be connected to the fourth part 134. A side 21 of the first part 131 may be perpendicular to a side 22 of the second part 132, a side 23 of the third part 133 may be perpendicular to the side 22 of the second part 132, and a side 24 of the fourth part 134 may be perpendicular to the side 23 of the third part 133. If the first part 131 (or the side 21) extends along a direction D1, the second part 132 (or the side 22) may extend along a direction D2 perpendicular to the direction D1, the third part 133 (or the side 23) may extend along the direction D1 to point to the metal member 140, and the fourth part 134 (or the side 24) may extend along a direction D4 that is parallel and opposite to the direction D2 to point to the first part 131.

In summary, the antenna device of the present disclosure is capable of using signal cables instead of printed circuits to transmit or receive wireless signals. The shape of the signal cable or the grounding component can be adjusted by the users for different frequency bands based on their needs. The fixing member of the casing is adapted to fix the signal cable to adjust the wiring of the signal cable. Accordingly, the antenna device of the present disclosure may replace the conventional PCB antenna device.

What is claimed is:

1. An antenna device installed in an electronic device with a wireless communication function, the antenna device comprising:

a signal cable, comprising a signal portion and a grounding portion;

a casing, wherein the signal cable is fixed on the casing, wherein the casing comprises at least one fixing member, and the signal cable is fixed to the casing by the at least one fixing member, wherein the at least one fixing member comprises a rib of the casing;

a grounding component; and a metal member, wherein the grounding portion is connected to the metal member through the grounding component.

2. The antenna device according to claim 1, wherein the grounding component comprises a first part connected to the metal member and a second part connected to the first part.

3. The antenna device according to claim 2, wherein a first side of the first part is perpendicular to a second side of the second part.

4. The antenna device according to claim 3, wherein the signal portion extends along a direction parallel to the second side.

5. The antenna device according to claim 1, wherein the grounding component is disposed between the signal cable and the casing.

6. The antenna device according to claim 1, wherein the signal cable is disposed between the grounding component and the casing.

7. The antenna device according to claim 1, wherein the grounding component and the metal member are formed integrally.

8. The antenna device according to claim 1, wherein the grounding component comprises one of copper foil and aluminum foil.

9. The antenna device according to claim 1, wherein the metal member is a system grounding of an electronic device.

10. The antenna device according to claim 1, wherein the casing is a chassis of an electronic device, and the signal cable is fixed to an inner face of the chassis.

11. The antenna device according to claim 1, wherein the signal cable is a coaxial cable, the grounding portion comprises a metal material, and the signal portion comprises a core wire and an insulating layer.

12. The antenna device according to claim 1, wherein the grounding portion is connected to the grounding component through one of solder and conductive glue.

13. The antenna device according to claim 1, wherein a length of the signal portion is equal to a quarter wavelength of a first radio frequency signal.

14. The antenna device according to claim 13, wherein a length of the signal portion is equal to a three-quarter wavelength of a second radio frequency signal.

15. The antenna device according to claim 3, wherein a longest distance between the grounding portion and the second part is equal to a quarter wavelength of a third radio frequency signal.

16. The antenna device according to claim 2, wherein the second part comprises a meandering structure.

17. The antenna device according to claim 16, wherein the meandering structure extends along a direction perpendicular to a first side of the first part.

18. The antenna device according to claim 3, wherein the grounding component further comprises a third part connected to the first part, and a third side of the third part is perpendicular to the first side of the first part.

19. The antenna device according to claim 18, wherein the grounding portion is connected electrically to at least one of the first part and the third part.

20. The antenna device according to claim 3, wherein the grounding component further comprises a third part extending along a first direction perpendicular to the second side, and the third part is connected to the second part.

21. The antenna device according to claim 20, wherein the grounding component further comprises a fourth part extending along a fourth direction parallel to the second side, and the fourth part is connected to the third part.

22. The antenna device according to claim 3, wherein the grounding component further comprises a third part extending along a third direction parallel to the first side, and the third part is connected to the first part.

* * * * *